US010714258B2

(12) United States Patent
Ishikura et al.

(10) Patent No.: US 10,714,258 B2
(45) Date of Patent: Jul. 14, 2020

(54) STATIONARY INDUCTION APPARATUS

(71) Applicant: MITSUBISHI ELECTRIC CORPORATION, Chiyoda-ku, Tokyo (JP)

(72) Inventors: Takahiko Ishikura, Tokyo (JP); Kazuaki Aono, Tokyo (JP); Kenichi Mino, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 385 days.

(21) Appl. No.: 15/737,391

(22) PCT Filed: Aug. 10, 2015

(86) PCT No.: PCT/JP2015/072629
§ 371 (c)(1),
(2) Date: Dec. 18, 2017

(87) PCT Pub. No.: WO2017/026028
PCT Pub. Date: Feb. 16, 2017

(65) Prior Publication Data

US 2018/0166209 A1 Jun. 14, 2018

(51) Int. Cl.
*H01F 27/10* (2006.01)
*H01F 27/32* (2006.01)
(Continued)

(52) U.S. Cl.
CPC ..... *H01F 27/327* (2013.01); *H01F 27/12* (2013.01); *H01F 27/2885* (2013.01);
(Continued)

(58) Field of Classification Search
CPC ..... H01F 27/2885
(Continued)

(56) References Cited

U.S. PATENT DOCUMENTS 3,376,530 A * 4/1968 Fischer ..... H01F 27/343 336/70
3,996,544 A * 12/1976 Mori ..... H01F 27/04 336/60
(Continued)

FOREIGN PATENT DOCUMENTS

JP S 42-251 Y1 1/1967
JP 53-50819 Y2 12/1978
(Continued)

OTHER PUBLICATIONS

International Search Report (PCT/ISA/210) dated Oct. 20, 2015, by the Japan Patent Office as the International Searching Authority for International Application No. PCT/JP2015/072629.
(Continued)

*Primary Examiner* — Ronald Hinson
(74) *Attorney, Agent, or Firm* — Buchanan Ingersoll & Rooney PC

(57) ABSTRACT

A stationary induction apparatus includes a winding formed of a plurality of winding layers disposed in a central axis direction, an insulating barrier and an insulating oil. The insulating barrier includes a first extension extending radially outwardly of the winding and partitioning the outer peripheral ends, a second extension bent from an end of the first extension, extending toward one side in the central axis direction, and covering at least a part of one outer peripheral end of the outer peripheral ends, a third extension bent from an end of the second extension and extending radially outwardly of the winding, and a fourth extension bent from an end of the third extension, extending toward the other side in the central axis direction, and covering at least a part of the other outer peripheral end of the outer peripheral ends. The fourth extension faces the second extension with a spacing therebetween.

9 Claims, 10 Drawing Sheets

(51) Int. Cl.
*H01F 27/28* (2006.01)
*H01F 27/12* (2006.01)
*H01F 27/02* (2006.01)

(52) U.S. Cl.
CPC ..... *H01F 27/323* (2013.01); *H01F 27/022* (2013.01); *H01F 27/2871* (2013.01)

(58) Field of Classification Search
USPC ..... 336/58
See application file for complete search history.

(56) References Cited

U.S. PATENT DOCUMENTS 6,838,968 B2 * 1/2005 Nick ..... H01F 27/12 336/57
6,867,674 B1 * 3/2005 Schutte ..... H01F 27/2823 336/180
9,099,238 B2 * 8/2015 Eriksson ..... H01F 27/12
2001/0052835 A1 * 12/2001 Ito ..... H01F 27/322 336/57
2010/0007452 A1 * 1/2010 Forsberg ..... H01F 27/2885 336/90
2012/0161912 A1 * 6/2012 Kainaga ..... H01F 27/12 336/60
2013/0243033 A1 * 9/2013 Asano, Jr. ..... H01F 27/402 374/152

FOREIGN PATENT DOCUMENTS

JP S 55-34669 U 3/1980
JP S 62-168620 U 10/1987
JP S 63-245915 A 10/1988
JP H 04-1691 Y2 1/1992

OTHER PUBLICATIONS

Written Opinion (PCT/ISA/237) dated Oct. 20, 2015, by the Japan Patent Office as the International Searching Authority for International Application No. PCT/JP2015/072629.

* cited by examiner

STATIONARY INDUCTION APPARATUS

TECHNICAL FIELD

The present invention relates to stationary induction apparatuses, and particularly, to a stationary induction apparatus including an insulating barrier.

BACKGROUND ART

Japanese Patent Laying-Open No. 63-245915 (Patent Document 1) is a prior art publication that discloses a configuration of a stationary induction apparatus including an insulating barrier. In the winding body described in Patent Document 1, an insulating sheet is provided on the inner periphery of a winding wound into a square tube, and a portion of the insulating sheet, which projects from the end of the winding, is folded outwardly and overlapped with the end of the winding. Slits extending axially are provided at least at the portions of the insulating paper which correspond to the positions of the corners of the square-tube-shaped winding, thereby forming small pieces. The bases of these small pieces are folded inwardly and then folded outwardly, thereby forming a folded insulating barrier.

CITATION LIST

Patent Documents

PTD 1: Japanese Patent Laying-Open No. 63-245915

SUMMARY OF INVENTION

Technical Problem

In the insulating barrier described in Patent Document 1, the end of the winding is covered only by a portion of the insulating sheet extending from the folded portion toward one side in the central axis direction of the winding. This fails to prevent the progression of an electric discharge generated from the other side in the central axis direction of the winding with respect to the insulating barrier, leaving a room for further improvement in insulating performance.

In a stationary induction apparatus with its windings immersed in an insulating oil, such as an oil-immersed transformer, any air bubble inside the apparatus may cause an electric discharge in the air bubble. When an insulating sheet is folded back to form an insulating barrier, as described in Patent Document 1, an air bubble is likely to remain inside the folded portion, and accordingly, an electric discharge is likely to occur. Thus, insulating property cannot be improved stably.

The present invention has been made in view of the above problem, and has an object to provide a stationary induction apparatus having stably improved insulating performance.

Solution to Problem

A stationary induction apparatus according to the present invention includes a winding formed of a plurality of winding layers arranged in a central axis direction, an insulating barrier disposed between outer peripheral ends, which are not connected to each other, of the winding layers adjacent to each other in the central axis direction, and an insulating oil in which each of the winding and the insulating barrier is immersed. The insulating barrier includes a first extension extending radially outwardly of the winding and partitioning between the outer peripheral ends, a second extension bent from an end of the first extension, extending toward one side in the central axis direction, and covering at least a part of one outer peripheral end of the outer peripheral ends, a third extension bent from an end of the second extension and extending radially outwardly of the winding, and a fourth extension bent from an end of the third extension, extending toward the other side in the central axis direction, and covering at least a part of the other outer peripheral end of the outer peripheral ends. The fourth extension faces the second extension with a spacing therebetween.

Advantageous Effects of Invention

The present invention can prevent the progression of an electric discharge generated from each of one side and the other side in the central axis direction of the winding with respect to the insulating barrier, and also restrict the generation of an electric discharge due to a remaining air bubble, thereby stably improving the insulating performance of the stationary induction apparatus.

DESCRIPTION OF EMBODIMENTS

Figure 1:
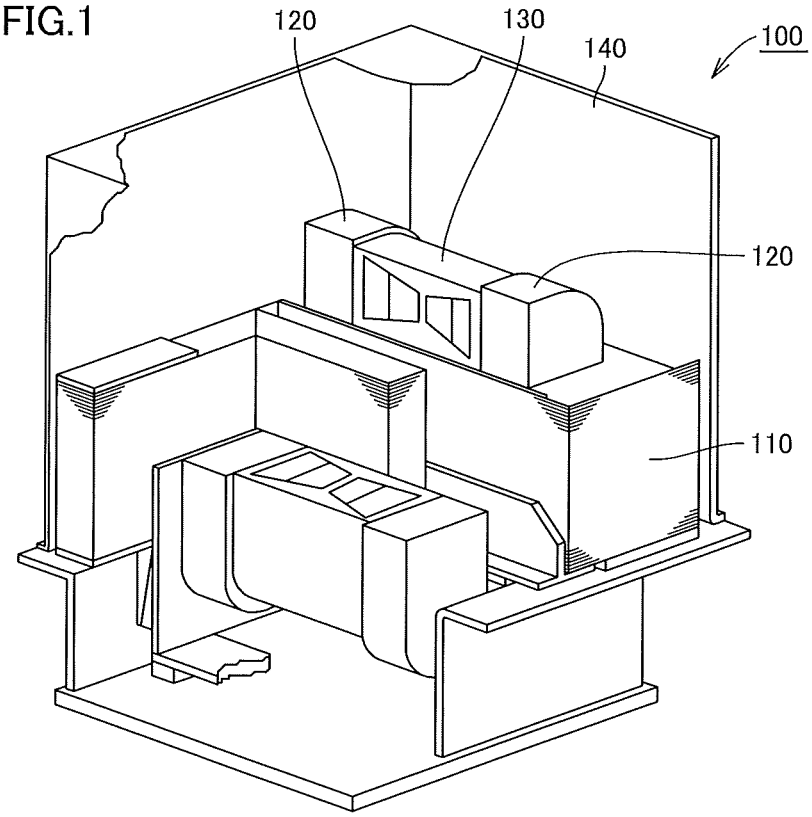
FIG. 1 is a perspective view showing a configuration of a stationary induction apparatus according to Embodiment 1 of the present invention.

Stationary induction apparatuses according to the respective embodiments of the present invention will be described below with reference to the drawings. In the drawings, the same or corresponding components are denoted by the same reference signs, and a description thereof will not be repeated. Although the following embodiments will be described by taking a shell-type transformer as an example stationary induction apparatus, the stationary induction apparatus is not limited to a shell-type transformer and may be, for example, a core-type transformer or a reactor.

Embodiment 1

Figure 2:
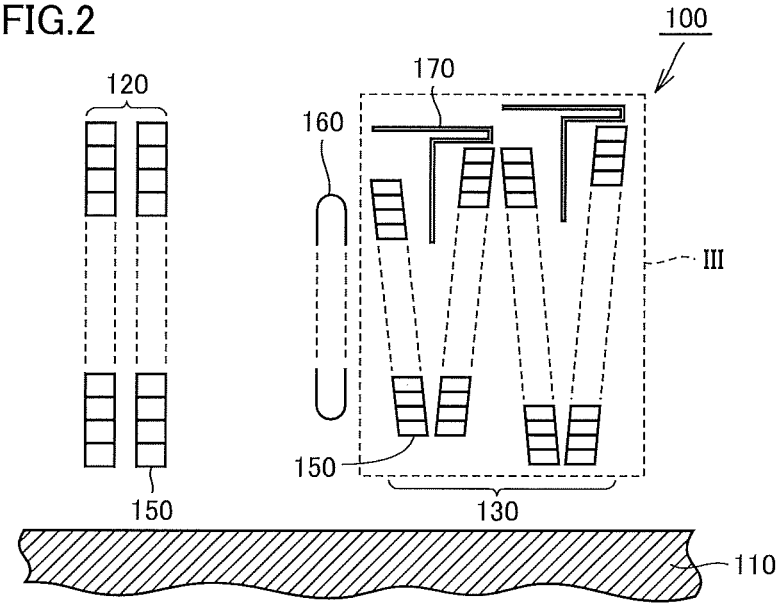
FIG. 2 is a partial sectional view of the stationary induction apparatus according to Embodiment 1 of the present invention.
Figure 3:
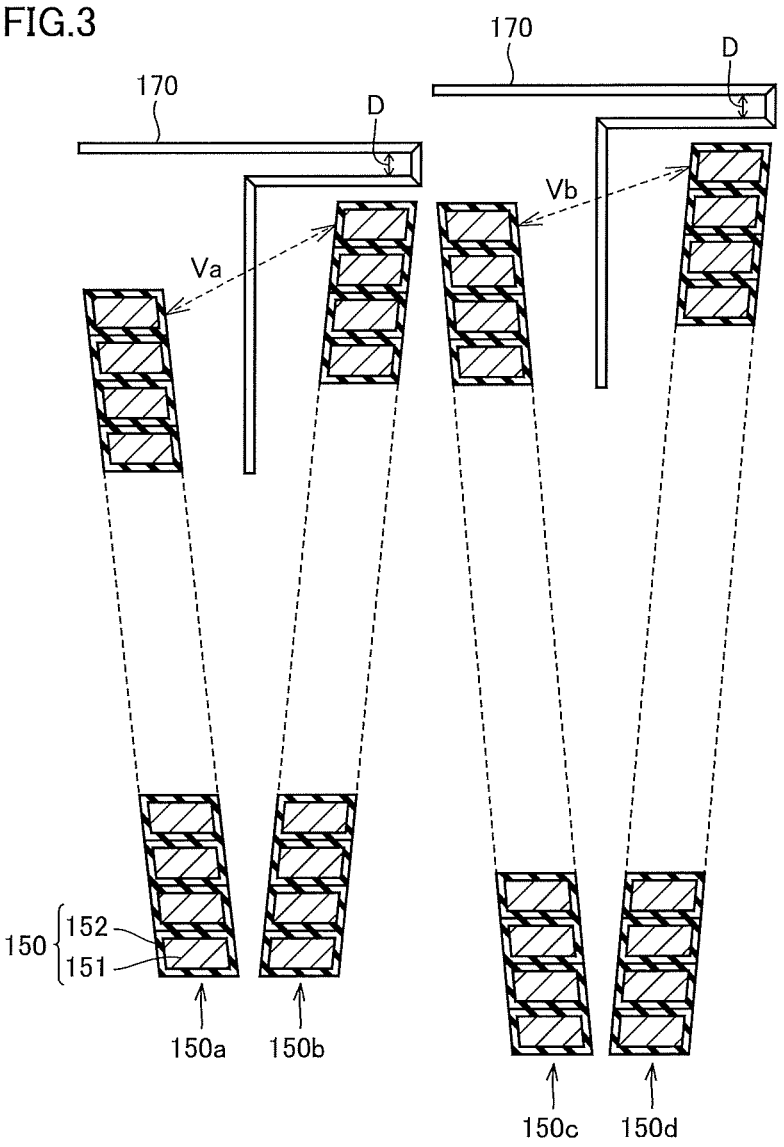
FIG. 3 is a sectional view of the stationary induction apparatus according to Embodiment 1 of the present invention, showing a portion III of FIG. 2 in enlarged view.

FIG. 1 is a perspective view showing a configuration of a stationary induction apparatus according to Embodiment 1 of the present invention. FIG. 2 is a partial sectional view of the stationary induction apparatus according to Embodiment 1 of the present invention. FIG. 3 is a sectional view of the stationary induction apparatus according to Embodiment 1 of the present invention, showing a portion III of FIG. 2 in enlarged view. FIG. 1 shows each component in cutaway view. FIG. 2 shows windings and insulating barriers 170 located above cores 110.

As shown in FIGS. 1 to 3, a stationary induction apparatus 100 according to Embodiment 1 of the present invention is a shell-type transformer. Stationary induction apparatus 100 includes cores 110, windings (low-voltage windings 120 and a high-voltage winding 130) concentrically wound around the main legs of cores 110, where each of the main legs is a central axis, a tank 140, and insulating barriers 170. The axial direction of the winding will be hereinafter referred to as a central axis direction.

Core 110 is formed of a plurality of layered magnetic steel plates. In the present embodiment, two cuboid-shaped cores 110 each having an opening at its middle portion are disposed to be adjacent to each other.

The windings (low-voltage windings 120 and high-voltage winding 130) are wound around the adjacent main legs of the two cores 110 so as to pass through the respective openings of the two cores 110. High-voltage winding 130 is disposed in the central axis direction so as to be sandwiched between low-voltage windings 120.

The windings (low-voltage windings 120 and high-voltage winding 130) are each formed of a plurality of discal winding layers (discal windings) layered to be arranged in the central axis direction. Each of the winding layers is formed of a flat-type electric wire 150 wound in a disc shape. Flat-type electric wire 150 includes an electric wire portion 151, which has an approximately rectangular shape in transverse section, and an insulating coating 152, which coats electric wire portion 151. Although not shown, low-voltage winding 120 also has a configuration similar to that of high-voltage winding 130.

The winding layers adjacent in the central axis direction are connected to each other by an electric conductor (not shown) at their respective outer peripheral ends or inner peripheral ends to be electrically connected to each other. In the present embodiment, sequentially in the central axis direction in high-voltage winding 130, a first winding layer 150*a* and a second winding layer 150*b* are connected to each other at their inner peripheral ends, second winding layer 150*b* and a third winding layer 150*c* are connected to each other at their outer peripheral ends, and third winding layer 150*c* and a fourth winding layer 150*d* are connected to each other at their inner peripheral ends.

Tank 140 is filled with an insulating oil that is an insulating medium as well as a cooling medium. Cores 110, windings (low-voltage windings 120 and high-voltage winding 130), and insulating barriers 170 are each housed in tank 140 and immersed in the insulating oil.

Stationary induction apparatus 100 further includes a plurality of annular electrostatic shields 160 disposed adjacent to the respective ends of low-voltage windings 120 and high-voltage winding 130 in the central axis direction. FIG. 2 shows only one electrostatic shield 160 adjacent to high-voltage winding 130.

Insulating barrier 170 is disposed between the outer peripheral ends, which are not connected to each other, of the winding layers adjacent to each other in the central axis direction. In the present embodiment, insulating barrier 170 is disposed between the outer peripheral ends of first winding layer 150*a* and second winding layer 150*b* and between the outer peripheral ends of third winding layer 150*c* and fourth winding layer 150*d*. A plurality of insulating barriers 170 are disposed between the adjacent winding layers so as to be successively disposed over the entire periphery of the winding.

Figure 4:
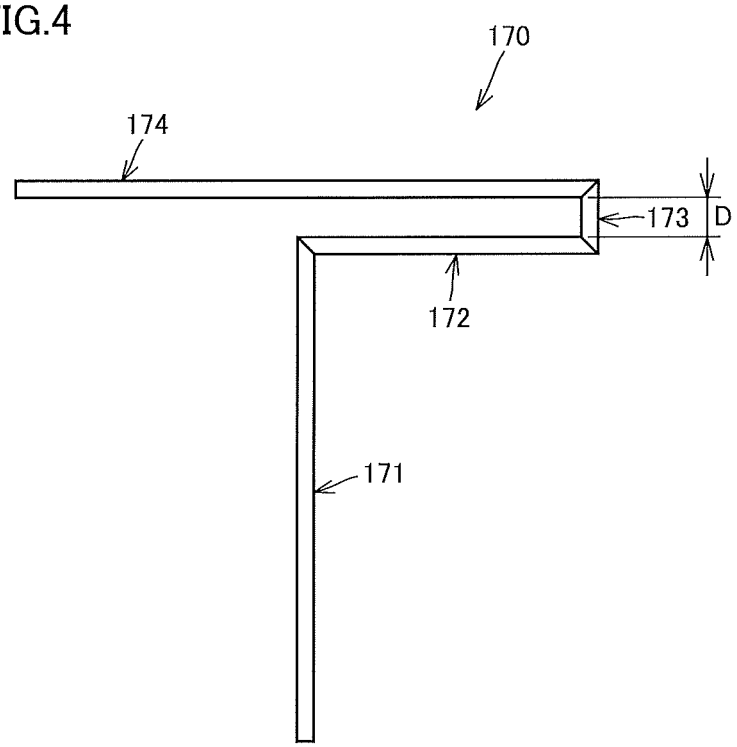
FIG. 4 is a side view showing a structure of an insulating barrier of the stationary induction apparatus according to Embodiment 1 of the present invention.

FIG. 4 is a side view showing a structure of an insulating barrier of the stationary induction apparatus according to Embodiment 1 of the present invention. As shown in FIGS. 2 to 4, insulating barrier 170 includes a first extension 171 extending radially outwardly of the winding and partitioning the outer peripheral ends, a second extension 172 bent from an end of first extension 171, extending toward one side in the central axis direction, and covering at least a part of one outer peripheral end of the outer peripheral ends, a third extension 173 bent from an end of second extension 172 and extending radially outwardly of the winding, and a fourth extension 174 bent from an end of third extension 173, extending toward the other side in the central axis direction, and covering at least a part of the other outer peripheral end of the outer peripheral ends. Fourth extension 174 faces second extension 172 with a spacing D therebetween.

Herein, insulating barrier 170 disposed between the outer peripheral ends of first winding layer 150*a* and second winding layer 150*b* will be described specifically. First extension 171 is inserted between a portion of first winding layer 150*a*, which is close to the outer periphery, and a portion of second winding layer 150*b*, which is close to the outer periphery. Second extension 172 is bent or curved at the extreme end of first extension 171 and extends toward the outer peripheral end of second winding layer 150*b* in the central axis direction. Second extension 172 covers at least a part of the outer peripheral end of second winding layer 150*b*.

In the present embodiment, first extension 171 and second extension 172 are approximately perpendicular to each other. The extreme end of second extension 172 reaches above one end in the central axis direction at the outer peripheral end of second winding layer 150*b*.

Third extension 173 is bent or curved at the extreme end of second extension 172 and extends radially outwardly of the winding. In the present embodiment, third extension 173 has a flat shape. Second extension 172 and third extension 173 are approximately perpendicular to each other. Alternatively, third extension 173 may have a semicircular cylindrical shape convexly projecting toward one side in the central axis direction.

Fourth extension 174 is bent or curved at the extreme end of third extension 173 and extends toward the outer peripheral end of first winding layer 150*a* in the central axis direction. Fourth extension 174 covers at least a part of the outer peripheral end of first winding layer 150*a*.

In the present embodiment, third extension 173 and fourth extension 174 are approximately perpendicular to each other. The extreme end of fourth extension 174 reaches above the other end in the central axis direction at the outer peripheral end of first winding layer 150*a*.

Second extension 172 and fourth extension 174 may extend in the directions opposite to the above directions. Specifically, second extension 172 may extend toward the outer peripheral end of first winding layer 150*a* in the central axis direction and cover at least a part of the outer peripheral end of first winding layer 150*a*, and fourth extension 174 may extend toward the outer peripheral end of second winding layer 150*b* in the central axis direction and cover at least a part of the outer peripheral end of second winding layer 150*b*.

Figure 5:
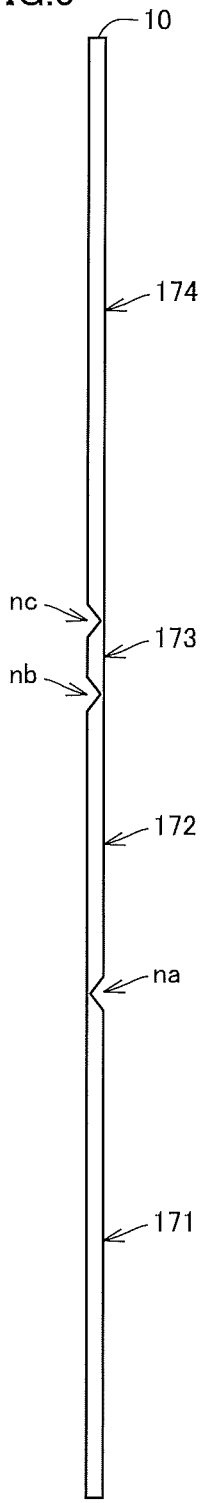
FIG. 5 is a side view showing a shape of an insulating plate forming the insulating barrier of the stationary induction apparatus according to Embodiment 1 of the present invention.

The method of forming insulating barrier 170 according to the present embodiment will now be described. FIG. 5 is a side view showing the shape of an insulating plate forming the insulating barrier of the stationary induction apparatus according to Embodiment 1 of the present invention.

As shown in FIG. 5, insulating barrier 170 is formed of one insulating plate 10. In the present embodiment, insulating plate 10 is a pressboard. On one main surface of insulating plate 10 is provided a first notch na, which is located at a boundary between first extension 171 and second extension 172. On the other main surface of insulating plate 10 are provided a second notch nb, which is located at a boundary between second extension 172 and third extension 173, and a third notch nc, which is located at a boundary between third extension 173 and fourth extension 174. First notch na, second notch nb, and third notch nc are each provided having a V-shape in side view.

Figure 6:
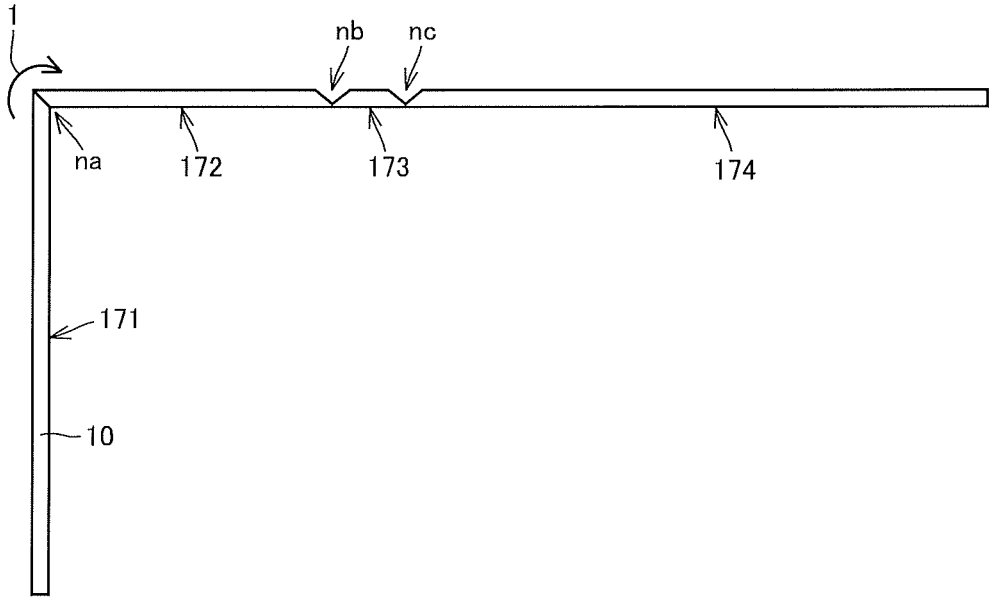
FIG. 6 is a side view showing the insulating barrier of the stationary induction apparatus according to Embodiment 1 of the present invention, which is bent at a first notch.

FIG. 6 is a side view of the insulating barrier of the stationary induction apparatus according to Embodiment 1 of the present invention, which is bent at the first notch. As shown in FIG. 6, insulating plate 10 is bent such that first notch na is located inwardly. With the inside surfaces of first notch na being in contact with each other, first extension 171 and second extension 172 are approximately perpendicular to each other.

Figure 7:
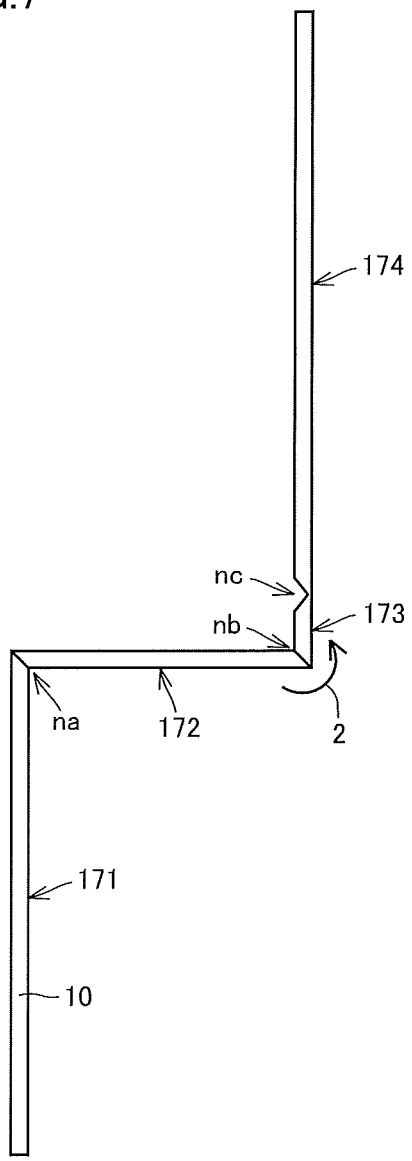
FIG. 7 is a side view of the insulating barrier of the stationary induction apparatus according to Embodiment 1 of the present invention, which is bent at a second notch.

FIG. 7 is a side view of the insulating barrier of the stationary induction apparatus according to Embodiment 1 of the present invention, which is bent at the second notch. As shown in FIG. 7, insulating plate 10 is bent such that second notch nb is located inwardly. With the inside surfaces of second notch nb being in contact with each other, second extension 172 and third extension 173 are approximately perpendicular to each other.

Figure 8:
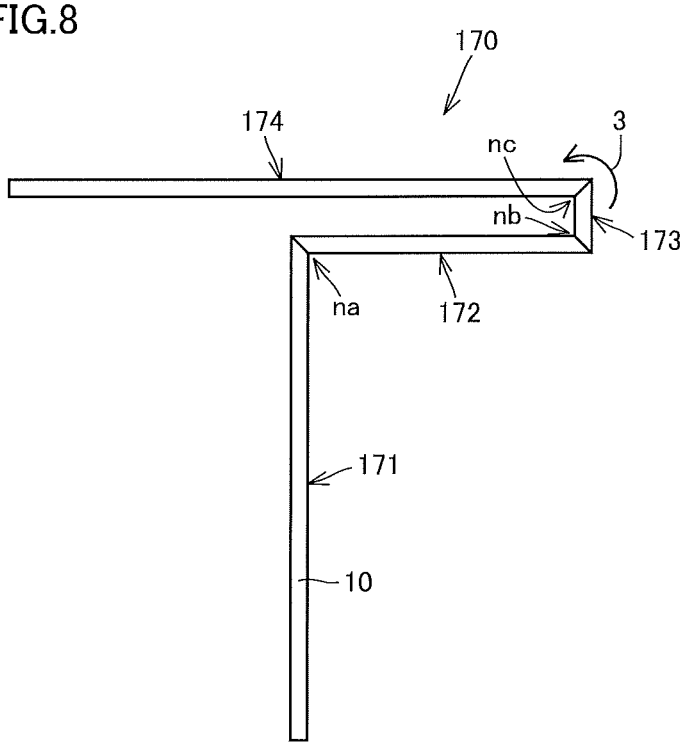
FIG. 8 is a side view of the insulating barrier of the stationary induction apparatus according to Embodiment 1 of the present invention, which is bent at a third notch.

FIG. 8 is a side view of the insulating barrier of the stationary induction apparatus according to Embodiment 1 of the present invention, which is bent at the third notch. As shown in FIG. 8, insulating plate 10 is bent such that third notch nc is located inwardly. With the inside surfaces of third notch nc being in contact with each other, third extension 173 and fourth extension 174 are approximately perpendicular to each other.

As described above, an insulating barrier 170 can be formed by bending one insulating plate 10. The sequence of bending one insulating plate 10 is not limited to the above, and one insulating plate 10 may be bent in the sequence of third notch nc, second notch nb, and first notch na. Alternatively, an insulating barrier 170 may be formed by integrally shaping an insulating resin such as polypropylene, not limited to the formation by bending one insulating plate 10.

The operation of the stationary induction apparatus according to Embodiment 1 of the present invention will be described below.

Upon application of high voltage to a winding, as shown in FIG. 3, a potential difference Va is generated between the outer peripheral ends of first winding layer 150*a* and second winding layer 150*b*, and a potential difference Vb is generated between the outer peripheral ends of third winding layer 150*c* and fourth winding layer 150*d*, in the winding. When an electric discharge generated due to potential differences Va, Vb reaches an adjacent winding layer, a dielectric breakdown occurs in stationary induction apparatus 100.

In insulating barrier 170 disposed between the outer peripheral ends of first winding layer 150*a* and second winding layer 150*b*, second extension 172 extends toward the outer peripheral end of second winding layer 150*b* in the central axis direction and covers at least a part of the outer peripheral end of second winding layer 150*b*, and fourth extension 174 extends toward the outer peripheral end of first winding layer 150*a* in the central axis direction and covers at least a part of the outer peripheral end of first winding layer 150*a*, while first extension 171 and third extension 173 partition the outer peripheral end of first winding layer 150*a* and the outer peripheral end of second winding layer 150*b* in the central axis direction. Insulating barrier 170 formed of one insulating plate 10 can partition the outer peripheral end of first winding layer 150*a* and the outer peripheral end of second winding layer 150*b* while covering both of these ends. In addition, the creepage distance between the outer peripheral end of first winding layer 150*a* and the outer peripheral end of second winding layer 150*b* can be increased.

As a result, an electric discharge generated in the vicinity of the outer peripheral end of first winding layer 150*a* can be prevented from progressing toward the outer peripheral end of second winding layer 150*b*. In addition, an electric discharge generated in the vicinity of the outer peripheral end of second winding layer 150*b* can be prevented from progressing toward the outer peripheral end of first winding layer 150*a*.

In insulating barrier 170 disposed between the outer peripheral ends of third winding layer 150*c* and fourth winding layer 150*d*, second extension 172 extends toward the outer peripheral end of fourth winding layer 150*d* in the central axis direction and covers at least a part of the outer peripheral end of fourth winding layer 150*d*, and fourth extension 174 extends toward the outer peripheral end of third winding layer 150*c* in the central axis direction and covers at least a part of the outer peripheral end of third winding layer 150*c*, while first extension 171 and third extension 173 partition the outer peripheral end of third winding layer 150*c* and the outer peripheral end of fourth winding layer 150*d* in the central axis direction. Insulating barrier 170 formed of one insulating plate 10 can partition the outer peripheral end of third winding layer 150*c* and the outer peripheral end of fourth winding layer 150*d* while covering both of these ends. In addition, the creepage distance between the outer peripheral end of third winding layer 150*c* and the outer peripheral end of fourth winding layer 150*d* can be increased.

As a result, an electric discharge generated in the vicinity of the outer peripheral end of third winding layer 150*c* can be prevented from progressing toward the outer peripheral end of fourth winding layer 150*d*. An electric discharge generated in the vicinity of the outer peripheral end of fourth winding layer 150*d* can be prevented from progressing toward the outer peripheral end of third winding layer 150*c*.

As described above, insulating barrier 170 according to the present embodiment can prevent the progression of both of an electric discharge generated from one side in the central axis direction of the winding with respect to insulating barrier 170, and an electric discharge generated from the other side in the central axis direction of the winding with respect to insulating barrier 170. In stationary induction apparatus 100 according to the present embodiment, the thickness of the portion of insulating barrier 170 which is inserted between the adjacent winding layers, is only the thickness of one insulating plate 10. This can prevent the progression of electric discharges generated from the opposite sides of insulating barrier 170 in the central axis direction of the winding while restricting stationary induction apparatus 100 from increasing in size due to the spacing between the winding layers increased by the space for insulating barrier 170.

Since fourth extension 174 faces second extension 172 with a spacing D therebetween, an insulating oil is more likely to permeate between second extension 172 and fourth extension 174, and an air bubble is less likely to reside therebetween. The generation of an electric discharge can thus be restricted.

As described above, stationary induction apparatus 100 according to the present embodiment can prevent, by one insulating barrier 170, the progression of an electric discharge generated from each of one side and the other side in the central axis direction of the winding with respect to insulating barrier 170. The stationary induction apparatus 100 can also restrict the generation of an electric discharge due to a remaining air bubble to have stably improved insulating performance.

Figure 9:
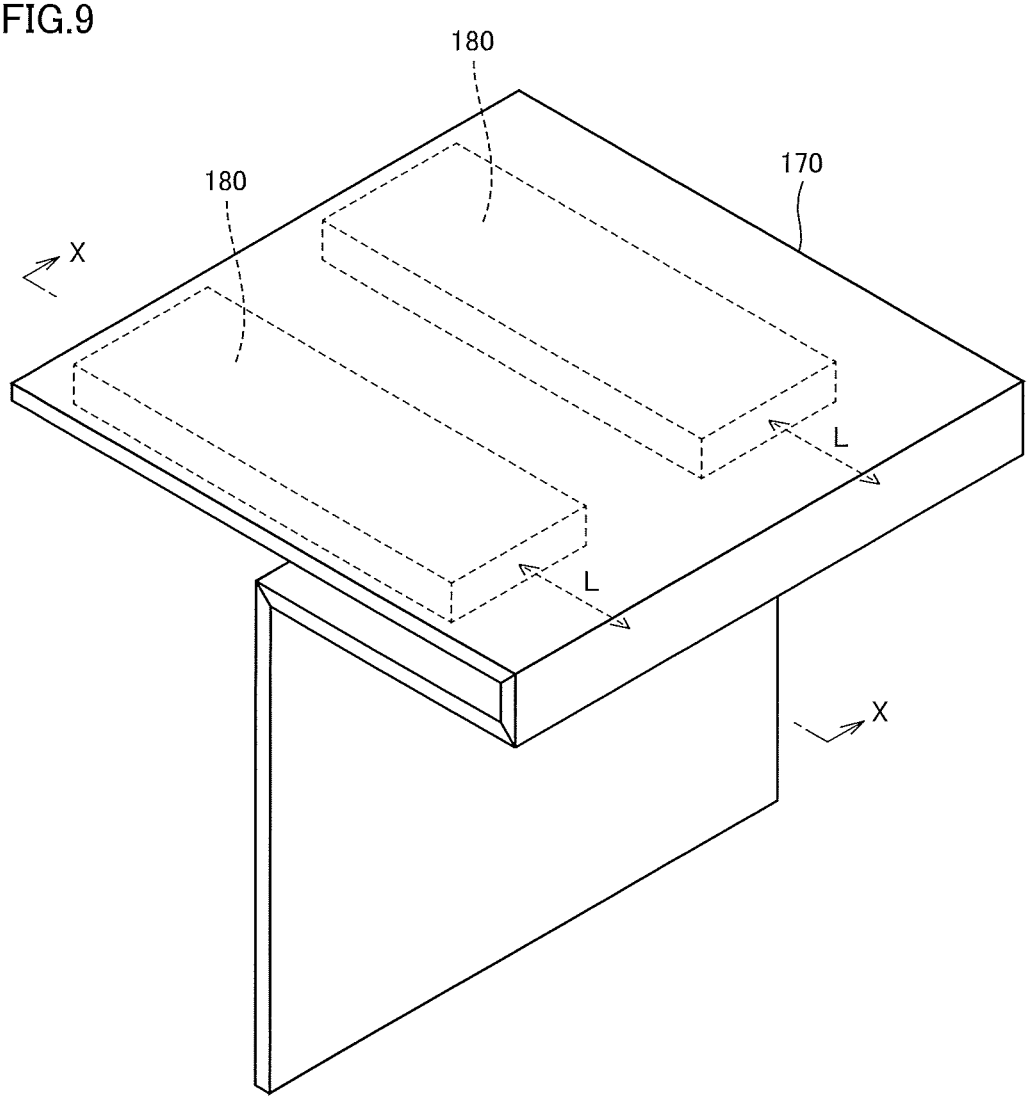
FIG. 9 is a perspective view showing a structure of an insulating barrier of a stationary induction apparatus according to a modification of Embodiment 1 of the present invention.
Figure 10:
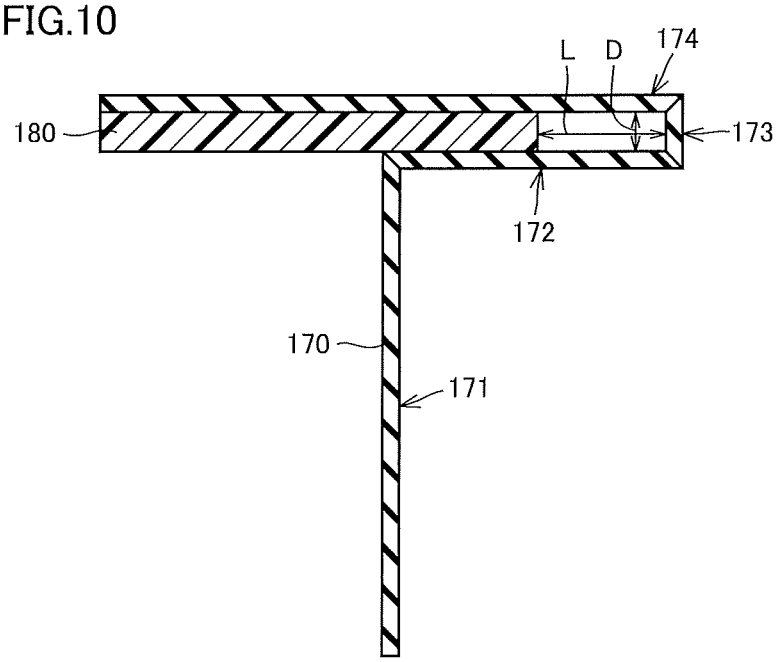
FIG. 10 is a sectional view of the insulating barrier of FIG. 9, seen from the direction indicated by the arrow X-X.

An insulating barrier of a stationary induction apparatus according to a modification of the present embodiment will now be described. FIG. 9 is a perspective view showing a structure of an insulating barrier of a stationary induction apparatus according to a modification of Embodiment 1 of the present invention. FIG. 10 is a sectional view of the insulating barrier of FIG. 9, seen from the direction indicated by the arrow X-X.

As shown in FIGS. 9 and 10, an insulating barrier 170 of the stationary induction apparatus according to the modification of the present embodiment further includes an insulating spacer 180 that is fixed to each of the surface of second extension 172 that faces a fourth extension 174 and the surface of fourth extension 174 that faces second extension 172, and extends in the central axis direction. In the present embodiment, two insulating spacers 180 are provided so as to be arranged with a spacing therebetween.

In the present embodiment, insulating spacer 180 has a cuboid outside shape and has a thickness D. However, the outside shape of insulating spacer 180 is not limited to a cuboid shape and may be, for example, a triangular prism shape. Insulating spacer 180 is formed of, for example, polypropylene or pressboard.

One main surface of insulating spacer 180 and second extension 172 are fixed to each other with an adhesive. The other main surface of insulating spacer 180 and fourth extension 174 are fixed to each other with an adhesive. Spacing D between second extension 172 and fourth extension 174 can be stably maintained for a long period of time by fixing second extension 172 and fourth extension 174 to each other with insulating spacer 180 therebetween as described above.

A clearance having a length L is left between a third extension 173 and the end of insulating spacer 180 which faces third extension 173. This clearance serves as a flow path for an insulating oil, and accordingly, the insulating oil is more likely to permeate between second extension 172 and fourth extension 174, and an air bubble is less likely to reside therebetween. This stably restricts the generation of an electric discharge due to a residing air bubble.

Embodiment 2

Figure 11:
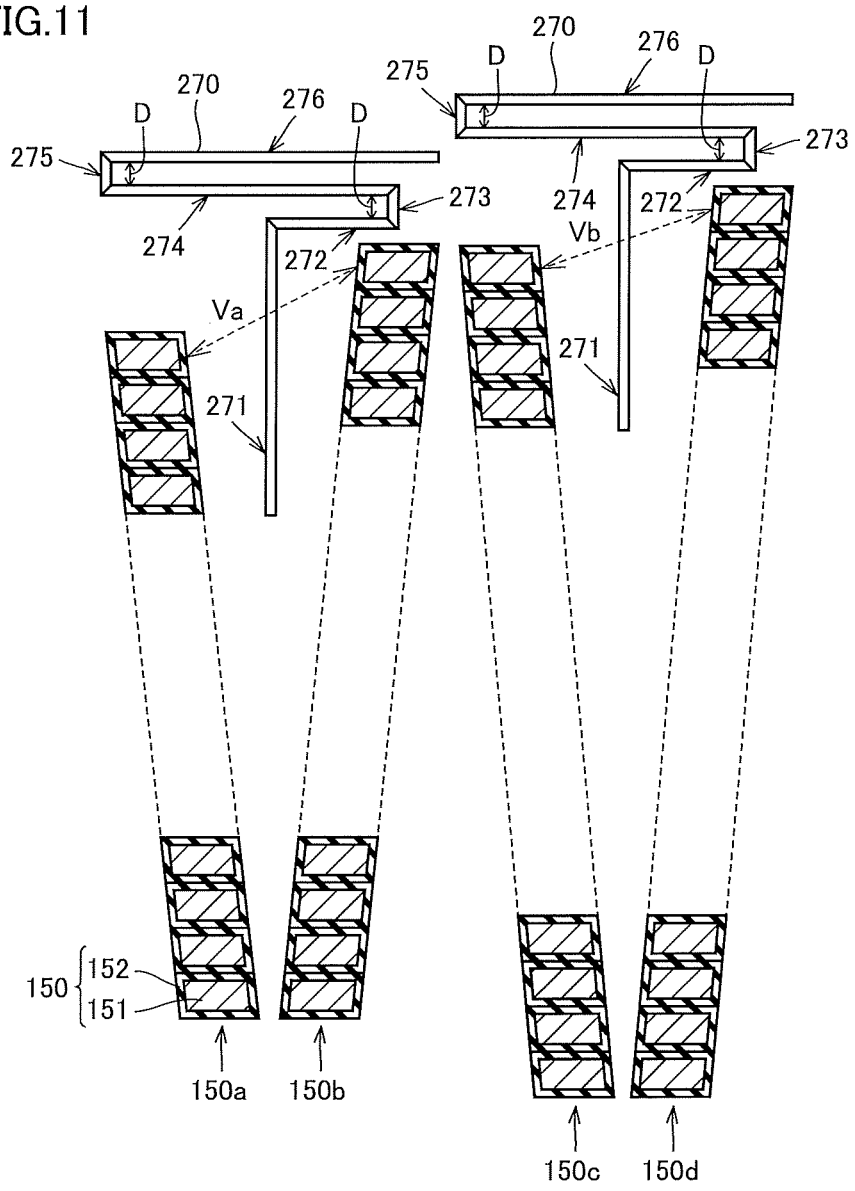
FIG. 11 is a sectional view of a stationary induction apparatus according to Embodiment 2 of the present invention.

A stationary induction apparatus according to Embodiment 2 of the present invention will be described below. FIG. 11 is a sectional view of the stationary induction apparatus according to Embodiment 2 of the present invention. FIG. 11 shows the same portion as that of FIG. 3.

As shown in FIG. 11, an insulating barrier 270 of the stationary induction apparatus according to Embodiment 2 of the present invention is disposed between the outer peripheral ends, which are not connected to each other, of the winding layers adjacent in the central axis direction. In the present embodiment, insulating barrier 270 is disposed between the outer peripheral ends of a first winding layer 150*a* and a second winding layer 150*b* and between the outer peripheral ends of a third winding layer 150*c* and a fourth winding layer 150*d*. A plurality of insulating barriers 270 are disposed so as to be successively disposed over the entire periphery of the winding.

Insulating barrier 270 includes a first extension 271 extending radially outwardly of the winding and partitioning the outer peripheral ends, a second extension 272 bent from an end of first extension 271, extending toward one side in the central axis direction, and covering at least a part of one outer peripheral end of the outer peripheral ends, a third extension 273 bent from an end of second extension 272 and extending radially outwardly of the winding, and a fourth extension 274 bent from an end of third extension 273, extending toward the other side in the central axis direction, and covering at least a part of the other outer peripheral end of the outer peripheral ends. Fourth extension 274 faces second extension 272 with a spacing D therebetween.

Insulating barrier 270 further includes a fifth extension 275 bent from an end of fourth extension 274 and extending radially outwardly of the winding and a sixth extension 276 bent from an end of fifth extension 275, extending toward the one side in the central axis direction, and covering at least a part of the one outer peripheral end. Sixth extension 276 faces fourth extension 274 with spacing D therebetween.

Herein, insulating barrier 270 disposed between the outer peripheral ends of first winding layer 150*a* and second winding layer 150*b* will be described specifically. First extension 271 is inserted between a portion of first winding layer 150*a*, which is close to the outer periphery, and a portion of second winding layer 150*b*, which is close to the outer periphery. Second extension 272 is bent or curved at the extreme end of first extension 271 and extends toward the outer peripheral end of second winding layer 150*b* in the central axis direction. Second extension 272 covers at least a part of the outer peripheral end of second winding layer 150*b*.

In the present embodiment, first extension 271 and second extension 272 are approximately perpendicular to each other. The extreme end of second extension 272 reaches above the other end in the central axis direction at the outer peripheral end of second winding layer 150*b*.

Third extension 273 is bent or curved at the extreme end of second extension 272 and extends radially outwardly of the winding. In the present embodiment, third extension 273 has a flat shape. Second extension 272 and third extension 273 are approximately perpendicular to each other. Alternatively, third extension 273 may have a semicircular cylindrical shape convexly projecting toward the one side in the central axis direction.

Fourth extension 274 is bent or curved at the extreme end of third extension 273 and extends toward the outer peripheral end of first winding layer 150*a* in the central axis direction. Fourth extension 274 covers at least a part of the outer peripheral end of first winding layer 150*a*.

In the present embodiment, third extension 273 and fourth extension 274 are approximately perpendicular to each other. The extreme end of fourth extension 274 reaches above the other end in the central axis direction at the outer peripheral end of first winding layer 150*a*.

Fifth extension 275 is bent or curved at the extreme end of fourth extension 274 and extends radially outwardly of the winding. In the present embodiment, fifth extension 275 has a flat shape. Fourth extension 274 and fifth extension 275 are approximately perpendicular to each other. Alternatively, fifth extension 275 may have a semicircular cylindrical shape convexly projecting toward the other side in the central axis direction.

Sixth extension 276 is bent or curved at the extreme end of fifth extension 275 and extends toward the outer peripheral end of second winding layer 150*b* in the central axis direction. The distal end of sixth extension 276 is located at the one side in the central axis direction with respect to third extension 273. Sixth extension 276 covers at least a part of the outer peripheral end of second winding layer 150*b*.

In the present embodiment, fifth extension 275 and sixth extension 276 are approximately perpendicular to each other. The extreme end of sixth extension 276 reaches above one end in the central axis direction at the outer peripheral end of second winding layer 150*b*.

Insulating barrier 270 is formed of one insulating plate. In the present embodiment, the insulating plate is a pressboard. Insulating barrier 270 is formed by bending one insulating plate.

The operation of the stationary induction apparatus according to Embodiment 2 of the present invention will be described below.

Upon application of high voltage to the winding, as shown in FIG. 11, a potential difference Va is generated between the outer peripheral ends of first winding layer 150*a* and second winding layer 150*b*, and a potential difference Vb is generated between the outer peripheral ends of third winding layer 150*c* and fourth winding layer 150*d*, in the winding. When an electric discharge generated due to potential differences Va, Vb reaches an adjacent winding layer, a dielectric breakdown occurs in the stationary induction apparatus.

In insulating barrier 270 disposed between the outer peripheral ends of first winding layer 150*a* and second winding layer 150*b*, second extension 272 and sixth extension 276 extend toward the outer peripheral end of second winding layer 150*b* in the central axis direction and cover at least a part of the outer peripheral end of second winding layer 150*b*, and fourth extension 274 extends toward the outer peripheral end of first winding layer 150*a* in the central axis direction and covers at least a part of the outer peripheral end of first winding layer 150*a*, while first extension 271, third extension 173, and fifth extension 275 partition the outer peripheral end of first winding layer 150*a* and the outer peripheral end of second winding layer 150*b* in the central axis direction. Insulating barrier 270 formed of one insulating plate can partition the outer peripheral end of first winding layer 150*a* and the outer peripheral end of second winding layer 150*b* while covering both of these ends. In addition, the creepage distance between the outer peripheral end of first winding layer 150*a* and the outer peripheral end of second winding layer 150*b* can be increased further.

As a result, an electric discharge generated in the vicinity of the outer peripheral end of first winding layer 150*a* can be prevented from progressing toward the outer peripheral end of second winding layer 150*b*. An electric discharge generated in the vicinity of the outer peripheral end of second winding layer 150*b* can be prevented from progressing toward the outer peripheral end of first winding layer 150*a*.

In insulating barrier 270 disposed between the outer peripheral ends of third winding layer 150*c* and fourth winding layer 150*d*, second extension 272 and sixth extension 276 extend toward the outer peripheral end of fourth winding layer 150*d* in the central axis direction and cover at least a part of the outer peripheral end of fourth winding layer 150*d*, and fourth extension 274 extends toward the outer peripheral end of third winding layer 150*c* in the central axis direction and covers at least a part of the outer peripheral end of third winding layer 150*c*, while first extension 271, third extension 273, and fifth extension 275 partition the outer peripheral end of third winding layer 150*c* and the outer peripheral end of fourth winding layer 150*d* in the central axis direction. Insulating barrier 270 formed of one insulating plate can partition the outer peripheral end of third winding layer 150*c* and the outer peripheral end of fourth winding layer 150*d* while covering both of these ends. In addition, the creepage distance between the outer peripheral end of third winding layer 150*c* and the outer peripheral end of fourth winding layer 150*d* can be increased further.

As a result, an electric discharge generated in the vicinity of the outer peripheral end of third winding layer 150*c* can be prevented from progressing toward the outer peripheral end of fourth winding layer 150*d*. An electric discharge generated in the vicinity of the outer peripheral end of fourth winding layer 150*d* can be prevented from progressing toward the outer peripheral end of third winding layer 150*c*.

As described above, insulating barrier 270 according to the present embodiment can prevent the progression of both of an electric discharge generated from one side in the central axis direction of the winding with respect to insulating barrier 270 and an electric discharge generated from the other side in the central axis direction of the winding with respect to insulating barrier 270. In stationary induction apparatus according to the present embodiment, the thickness of the portion of insulating barrier 270 which is inserted between the adjacent windings, is only the thickness of one insulating plate. This can prevent the progression of electric discharges generated from the opposite sides of insulating barrier 270 in the central axis direction of the winding while restricting the stationary induction apparatus from increasing in size due to the spacing between the adjacent winding layers which is increased by the space for insulating barrier 270.

Since fourth extension 274 faces second extension 272 with a spacing D therebetween, the insulating oil is more likely to permeate between second extension 272 and fourth extension 274, and an air bubble is less likely to reside therebetween. The generation of an electric discharge due to a remaining air bubble can thus be restricted. Since sixth extension 276 faces fourth extension 274 with spacing D therebetween, the insulating oil is more likely to permeate between fourth extension 274 and sixth extension 276, and an air bubble is less likely to reside therebetween. The generation of an electric discharge due to a remaining air bubble can thus be restricted.

As described above, the stationary induction apparatus according to the present embodiment can prevent, by one insulating barrier 270, the progression of an electric discharge generated from each of one side and the other side in the central axis direction of the winding with respect to insulating barrier 270. The stationary induction apparatus can also restrict the generation of an electric discharge due to a remaining air bubble to have stably improved insulating performance.

It should be construed that the embodiments disclosed herein are given by way of illustration in all respects, not by way of limitation. It is therefore intended that the scope of the present invention is defined by claims, not only by the embodiments described above, and encompasses all modifications and variations equivalent in meaning and scope to the claims.

REFERENCE SIGNS LIST

10: insulating plate; 100: stationary induction apparatus; 110: core; 120: low-voltage winding; 130: high-voltage winding; 140: tank; 150: flat-type electric wire; 150*a*: first winding layer; 150*b*: second winding layer; 150*c*: third winding layer; 150*d*: fourth winding layer; 151: electric wire portion; 152: insulating coating; 160: electrostatic shield; 170, 270: insulating barrier; 171, 271: first extension; 172, 272: second extension; 173, 273: third extension; 174, 274: fourth extension; 180: insulating spacer; 275: fifth extension; 276: sixth extension; na: first notch; nb: second notch; nc: third notch.

The invention claimed is:

1. A stationary induction apparatus comprising:

a winding formed of a plurality of winding layers disposed in a central axis direction;

an insulating barrier disposed between outer peripheral ends of the winding layers adjacent to each other in the central axis direction, the outer peripheral ends being not connected to each other; and an insulating oil in which each of the winding and the insulating barrier is immersed, the insulating barrier including a first extension extending radially outwardly of the winding and partitioning the outer peripheral ends, a second extension bent from an end of the first extension, extending toward one side in the central axis direction, and covering at least a part of one outer peripheral end of the outer peripheral ends, a third extension bent from an end of the second extension and extending radially outwardly of the winding, and a fourth extension bent from an end of the third extension, extending toward the other side in the central axis direction, and covering at least a part of the other outer peripheral end of the outer peripheral ends, the fourth extension facing the second extension with a spacing therebetween.

2. The stationary induction apparatus according to claim 1, wherein the insulating barrier further includes a fifth extension bent from an end of the fourth extension and extending radially outwardly of the winding, and a sixth extension bent from an end of the fifth extension, extending toward the one side in the central axis direction, and covering at least a part of the one outer peripheral end, wherein the sixth extension faces the fourth extension with a spacing therebetween, and wherein a distal end of the sixth extension is located at the one side in the central axis direction with respect to the third extension.

3. The stationary induction apparatus according to claim 1, wherein the insulating barrier further includes an insulating spacer fixed to each of a surface of the second extension that faces the fourth extension and a surface of the fourth extension that faces the second extension, the insulating spacer extending in the central axis direction, and a clearance is left between the third extension and an end of the insulating spacer facing the third extension.

4. The stationary induction apparatus according to claim 3, wherein the insulating barrier further includes a fifth extension bent from an end of the fourth extension and extending radially outwardly of the winding, and a sixth extension bent from an end of the fifth extension, extending toward the one side in the central axis direction, and covering at least a part of the one outer peripheral end, wherein the sixth extension faces the fourth extension with a spacing therebetween, and wherein a distal end of the sixth extension is located at the one side in the central axis direction with respect to the third extension.

5. The stationary induction apparatus according to claim 1, wherein the insulating barrier is formed of one bent insulating plate, one main surface of the insulating plate has a first notch located at a boundary between the first extension and the second extension, and the other main surface of the insulating plate has a second notch located at a boundary between the second extension and the third extension, and a third notch located at a boundary between the third extension and the fourth extension.

6. The stationary induction apparatus according to claim 5, wherein the insulating barrier further includes an insulating spacer fixed to each of a surface of the second extension that faces the fourth extension and a surface of the fourth extension that faces the second extension, the insulating spacer extending in the central axis direction, and a clearance is left between the third extension and an end of the insulating spacer facing the third extension.

7. The stationary induction apparatus according to claim 6, wherein the insulating barrier further includes a fifth extension bent from an end of the fourth extension and extending radially outwardly of the winding, and a sixth extension bent from an end of the fifth extension, extending toward the one side in the central axis direction, and covering at least a part of the one outer peripheral end, wherein the sixth extension faces the fourth extension with a spacing therebetween, and wherein a distal end of the sixth extension is located at the one side in the central axis direction with respect to the third extension.

8. The stationary induction apparatus according to claim 5, wherein the insulating barrier further includes a fifth extension bent from an end of the fourth extension and extending radially outwardly of the winding, and a sixth extension bent from an end of the fifth extension, extending toward the one side in the central axis direction, and covering at least a part of the one outer peripheral end, wherein the sixth extension faces the fourth extension with a spacing therebetween, and wherein a distal end of the sixth extension is located at the one side in the central axis direction with respect to the third extension.

9. The stationary induction apparatus according to claim 5, wherein the insulating plate comprises a pressboard.

* * * * *